US005752647A

United States Patent [19]

Schubert et al.

[11] Patent Number: 5,752,647

[45] Date of Patent: May 19, 1998

[54] ENVELOPE INTERMEDIATE WITH INTEGRAL MAIL-BACK PIECE

[75] Inventors: Lawrence Schubert, Kettering; Hugh B. Skees, Dayton, both of Ohio

[73] Assignee: The Standard Register Company, Dayton, Ohio

[21] Appl. No.: 731,899

[22] Filed: Oct. 22, 1996

Related U.S. Application Data

[63] Continuation of Ser. No. 388,299, Feb. 14, 1995, abandoned.

[51] Int. Cl.[6] ..... B65D 27/06

[52] U.S. Cl. ..... 229/92.1; 229/300; 229/305

[58] Field of Search ..... 229/300, 301, 229/302, 303, 304, 305, 70, 72, 92.1, 92.8

[56] References Cited

U.S. PATENT DOCUMENTS

| | | | |
|---|---|---|---|
| 642,839 | 2/1900 | D'Arcy | 229/70 |
| 2,270,455 | 1/1942 | Lichter | 229/92.1 X |
| 2,710,716 | 6/1955 | Duetschmeister et al. | 229/70 |
| 2,777,631 | 1/1957 | Zalkind | 299/301 X |
| 2,983,431 | 5/1961 | Turan | 229/300 X |
| 3,143,279 | 8/1964 | Black | 229/304 |
| 3,255,952 | 6/1966 | Black | 229/304 |
| 3,652,007 | 3/1972 | MacDougall | 229/304 |
| 3,813,028 | 5/1974 | Greason | 229/70 |
| 3,866,822 | 2/1975 | Faltin et al. | 229/301 X |
| 3,937,492 | 2/1976 | Biron | 229/303 X |
| 4,461,920 | 7/1984 | Ito et al. . | |
| 4,682,793 | 7/1987 | Walz . | |
| 4,801,076 | 1/1989 | Schoenleber et al. | 229/92.8 X |
| 4,892,246 | 1/1990 | Norman | 229/92.8 |
| 5,045,426 | 9/1991 | Maierson et al. . | |
| 5,183,203 | 2/1993 | Sanders . | |
| 5,190,210 | 3/1993 | Walz . | |
| 5,207,373 | 5/1993 | Tighe . | |
| 5,314,110 | 5/1994 | Lombardo | 229/92.1 |
| 5,346,123 | 9/1994 | Lombardo | 229/305 |
| 5,375,764 | 12/1994 | Sauerwine | 229/304 |
| 5,626,286 | 5/1997 | Petkovsek | 229/92.8 X |

FOREIGN PATENT DOCUMENTS

| | | | |
|---|---|---|---|
| 2225000 | 10/1974 | France | 229/300 |
| 3446783 | 6/1986 | Germany | 229/72 |

*Primary Examiner*—Jes F. Pascua

*Attorney, Agent, or Firm*—Killworth, Gottman, Hagan & Schaeff, L.L.P.

[57] ABSTRACT

An envelope intermediate having an integral mail-back piece is provided. The intermediate is formed form a single sheet of substrate material divided into four panels by fold lines. A first and second ply is provided in two adjacent panels so that when the intermediate is folded, a mail-back piece is created. The mail-back piece may be either a two-ply card or envelope. Provisions for a removable partition are also included.

8 Claims, 11 Drawing Sheets

ENVELOPE INTERMEDIATE WITH INTEGRAL MAIL-BACK PIECE

This application is a continuation of application Ser. No. 08/388,299, filed Feb. 14, 1995, now abandoned.

BACKGROUND OF THE INVENTION

The present invention relates to an envelope intermediate with an integral mail-back piece, and more particularly to an envelope intermediate which, upon folding creates not only an envelope but an integral mail-back piece that is easily detachable without opening the envelope.

In recent years, a rising demand for return receipts or signatures upon delivery has led to an increased demand for mailers and envelopes that include a return receipt or a mail-back piece, such as a postcard. A practical application of such envelopes and mailers is in certified or registered mail wherein the mail-back piece is returned as proof of delivery. For many years, manual methods have been used for mailing envelopes and packages. However, manual methods are time consuming and expensive. Thus, in recent years, attempts have been made to reduce the hand-work associated with such mailings. In addition, mailers and envelopes that can be easily printed in modern automated printing systems, such a laser, impact, ink jet, and thermal transfer printers are desired.

U.S. Pat. No. 4,892,246 to Norman discloses a simplified mailer including a return postcard. The mailer comprises two superimposed plies of card stock. However, Norman does not disclose an envelope and return card which may be formed from a single substrate sheet. Accordingly, the mailer of Norman may not be printed in a single pass through an automated printing system due to the superimposed plies of card stock.

U.S. Pat. No. 4,682,793 to Walz discloses a multi-part label which may contain a return or certified mail card and an automated printing system for the label. The label comprises several superimposed layers of sheet material. However, Walz also does not disclose an envelope and return card which may be formed from a single substrate sheet, and thus, can not be easily printed in automated printing systems. Rather, Waltz discloses a label for attachment to a package for mailing.

U.S. Pat. No. 5,183,203 to Sanders discloses a multi-purpose certified mail envelope assembly. The assembly comprises a first ply of two panels. One panel comprises an envelope body and the other a closure flap. A second ply is adhered to the envelope panel on the first ply forming the envelope. The return card is located in the closure flap panel of the first panel. However, again, Sanders does not disclose an envelope and return card formed from a single substrate sheet, and thus, cannot be easily printed in an automated printing systems. Further, a two-ply mail-back piece is not disclosed.

Accordingly, the need remains for an improved envelope intermediate containing an integral mail-back piece which is formed from a single substrate sheet, and thus, is ideally suited for processing with automated printing systems.

SUMMARY OF THE INVENTION

This need is met by the present invention wherein an envelope intermediate is provided. The envelope intermediate of the present invention includes an integral mail-back piece that is formed when the envelope intermediate is folded. The envelope intermediate of the present invention is ideally suited for certified or registered mailings. Furthermore, the envelope intermediate of the present invention is uniquely suited for the automated high speed printing systems common today and eliminates time consuming hand-work associated with manually completed forms and envelopes.

In accordance with one aspect of the present invention, an envelope intermediate is provided. The envelope intermediate comprises a substrate sheet having first and second surfaces, first and second opposite, parallel longitudinal edges and first and second opposing ends. First, second and third transverse fold lines are formed in the substrate perpendicular to the parallel longitudinal edges thereby dividing the substrate into first, second, third, and fourth panels. The first fold line separates the first and second panels, the second fold line separates the second and third panels, and the third fold line separates the third and fourth panels.

To form the integral mail-back piece of the present invention, lines of weakness are disposed in the second and third panels to form first and second plies, respectively. Preferably, the mail-back piece is a two-ply card or envelope. To secure the envelope and mail-back piece, a number of adhesive patterns are also provided. A first adhesive pattern is provided on the second surface of at least one of the first and second plies. A second adhesive pattern is provided on the second surface of at least one of the first and fourth panels adjacent the first and second longitudinal edges. Preferably, the first and second adhesive patterns are pressure activatable adhesives. Thus, when the substrate sheet is folded about the second fold line, the second surfaces of the first and fourth panels lie in contact forming an envelope. In addition, the second surfaces of the first and second plies lie in contact forming a mail-back piece.

A third adhesive pattern may be provided on the envelope intermediate to help secure the envelope intermediate when folded. The third adhesive pattern may be provided on the first surface on at least one of the first and second panels or the third and fourth panels. When the substrate is folded about the first and third fold lines, the first surfaces of either the first and second panels or the third and fourth panels lie in contact and adhere. Preferably, the third adhesive pattern is a pressure activatable adhesive.

A fourth adhesive pattern may be provided adjacent one of the first or second opposite ends to seal the envelope. A fourth fold line may be provided adjacent the fourth adhesive pattern to define an envelope closure flap. Preferably, the fourth adhesive pattern is a remoist adhesive. Lines of weakness may also be provided in at least one of the second or third panels defining partitions in those panels.

In an alternative embodiment of the present invention, an additional envelope intermediate is provided. Again, the envelope intermediate comprises a substrate sheet having first and second surfaces, first and second opposite, parallel longitudinal edges and first and second opposing ends. First, second and third transverse fold lines are formed in the substrate perpendicular to the parallel longitudinal edges thereby dividing the substrate into first, second, third, and fourth panels. The first fold line separates the first and second panels, the second fold line separates the second and third panels, and the third fold line separates the third and fourth panels.

To form the integral mail-back piece of the present invention, lines of weakness are disposed in the first and second panels to form first and second plies, respectively. Preferably, the mail-back piece is a two-ply card or envelope. To secure the envelope and mail-back piece, a number of adhesive patterns are also provided. A first adhesive pattern is provided on the second surface of at least one of the first and second plies. A second adhesive pattern is provided on the second surface of at least one of the third and fourth panels adjacent the first and second longitudinal edges. Preferably, the first and second adhesive patterns are pressure activatable adhesives. Thus, when the substrate sheet is folded about the third fold line, the second surfaces of the third and fourth panels lie in contact forming an envelope. In addition, when the substrate sheet is folded about the first fold line, the second surfaces of the first and second plies lie in contact forming a mail-back piece.

A third adhesive pattern may be provided on the envelope intermediate to help secure the envelope intermediate when folded. The third adhesive pattern may be provided on the first surface on at least one of the first and fourth panels. When the substrate is folded about the second fold line, the first surfaces of the first and fourth panels lie in contact and adhere. Preferably, the third adhesive pattern is a pressure activatable adhesive.

A fourth adhesive pattern may be provided adjacent the second fold line to seal the envelope. A fourth fold line may be provided adjacent the fourth adhesive pattern thereby defining an envelope closure flap. Preferably, the fourth adhesive pattern is a remoist adhesive. Lines of weakness may also be provided in at least one of the first or second panels defining partitions in those panels.

Accordingly, it is a feature of the present invention to provide an improved envelope intermediate having an integral mail-back piece. It is a further feature of the present invention to provide an envelope intermediate having an integral mail-back piece that is a two-ply card or envelope. These, and other features and advantages of the present invention will become apparent from the following detailed description, the accompanying drawings and the appended claims.

DETAILED DESCRIPTION OF THE PREFERRED EMBODIMENTS

The present invention relates to an envelope intermediate which contains an integral mail-back piece. The envelope intermediate contains four panels in a single substrate sheet that is suitable for simplex or duplex printing of variable or non-variable information such as preprinted return addresses, postage identification, or outgoing addresses. The printing may be accomplished with the various automated printing systems common today including impact, laser, thermal transfer and ink jet printers. The envelope intermediate can significantly reduce the hand-work associated with mailings requiring a return receipt. Further, the envelope intermediate is available in a continuous series in a folded pack or in single cut sheets.

Figure 1:
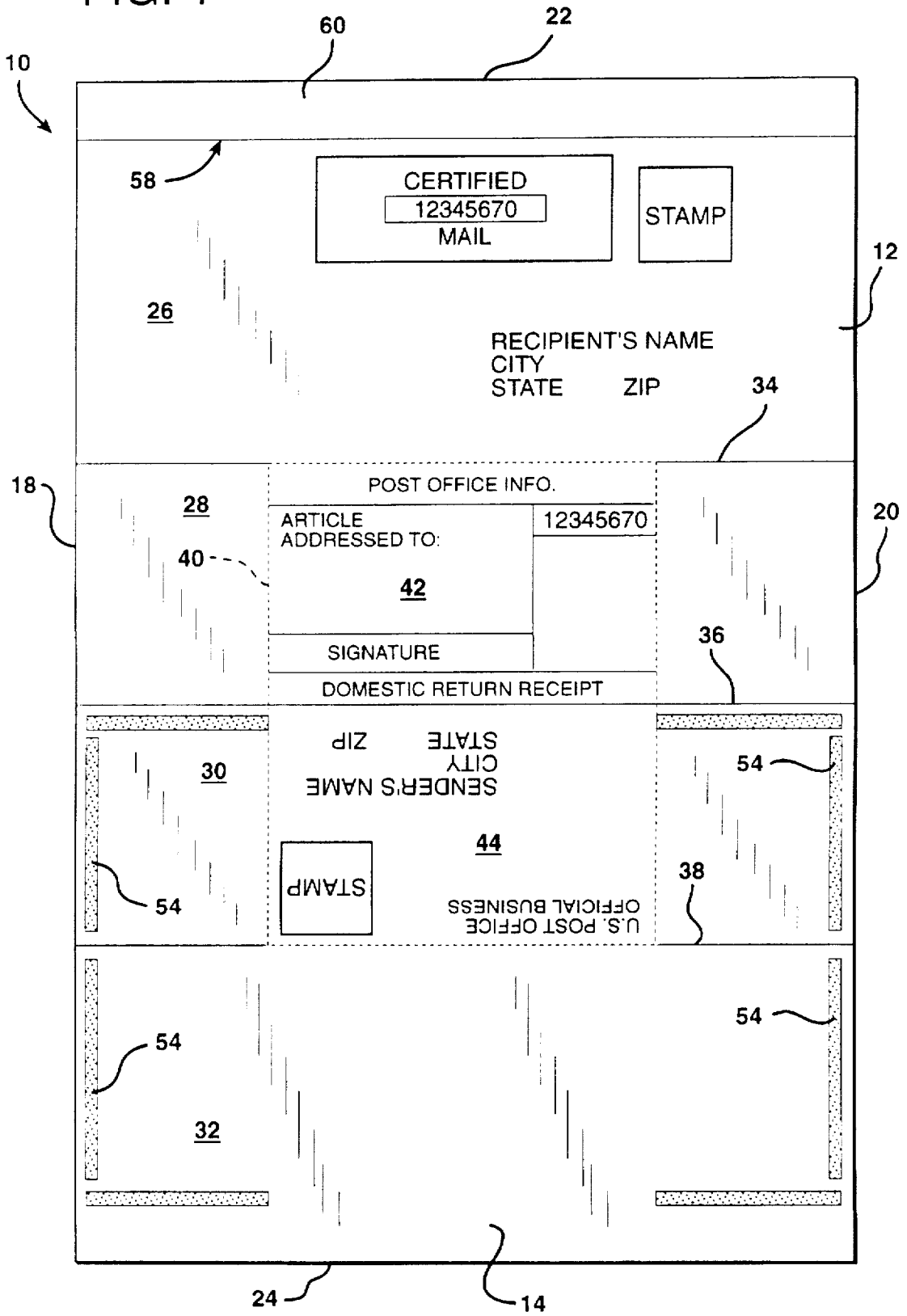
FIG. 1 is a plan view of the front (first) side of one embodiment of the envelope intermediate of the present invention containing a mail-back piece.
Figure 2:
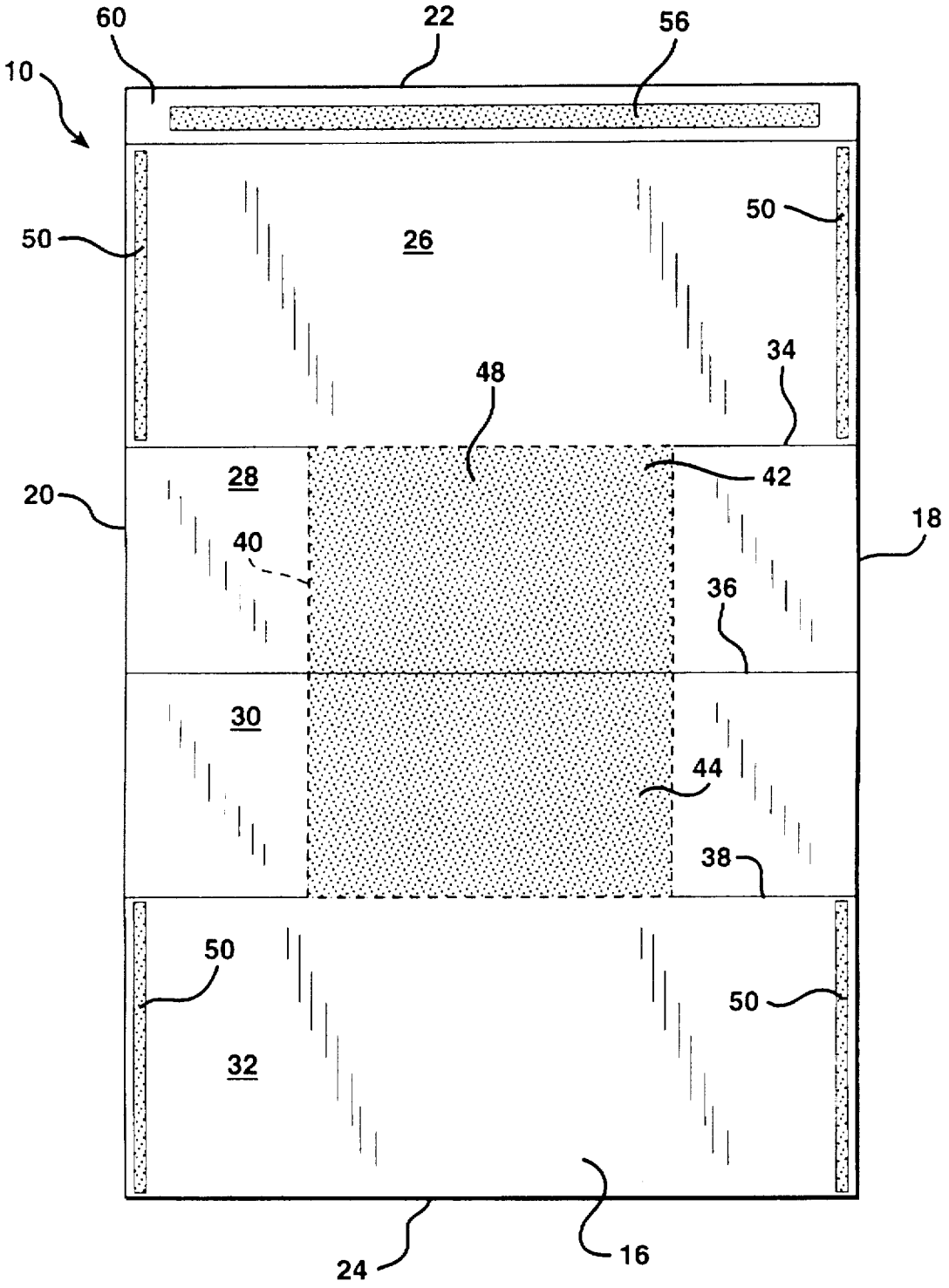
FIG. 2 is a plan view of the back (second) side of the embodiment shown in FIG. 1.

Referring now to FIGS. 1 and 2, a first embodiment of the envelope intermediate of the present invention is shown. Envelope intermediate 10 includes a substrate sheet 12. Substrate sheet 12 may be a single sheet or ply of any known material common in the art for substrate purposes such as paper of various weights. Thus, substrate 12 may be either simplex or duplex printed in a single pass through a printing system. Substrate sheet 12 includes first surface 14 and second surface 16, first longitudinal edge 18 and second longitudinal edge 20 and first end 22 and second end 24. First and second longitudinal edges, 18 and 20, respectively, are opposite and parallel each other. First and second ends, 22 and 24, respectively, also are opposite one another.

Substrate 12 is divided into a first panel 26, a second panel 28, a third panel 30 and a fourth panel 32 by means of first fold line 34, second fold line 36 and third fold line 38. Any of the first, second or third fold lines, 34, 36, 38, may be a line of weakness, such as a partial die cut or perforations, to facilitate removal of those panels by the user. First fold line 34 separates first panel 26 and second panel 28, second fold line 36 separates second panel 28 and third panel 30, and third fold line 38 separates third panel 30 and fourth panel 32.

Substrate 12 may be uncoated or coated on one or both of the first and second surfaces, 14 and 16. Preferably, substrate 12 is a paper coated on first surface 14 with a coating that enhances the bonding of toner images from various printers. These coatings make the image more durable. Toner adhesion enhancing coatings are known in the prior art and include those described in U.S. Pat. No. 5,045,426, the disclosure of which is hereby incorporated by reference.

The envelope intermediate 10 includes lines of weakness 40 disposed in the second and third panels, 28 and 30. The lines of weakness 40 define a first ply 42 in the second panel 28 and a second ply 44 in the third panel 30. First ply 42 and second ply 44 define the separate elements of the integral mail-back piece 46 of the present invention.

Turning now to FIGS. 3–6, there is seen the envelope intermediate 10 of the present invention. The intermediate 10 of the present invention may be a double V-fold mailer.

Figure 3:
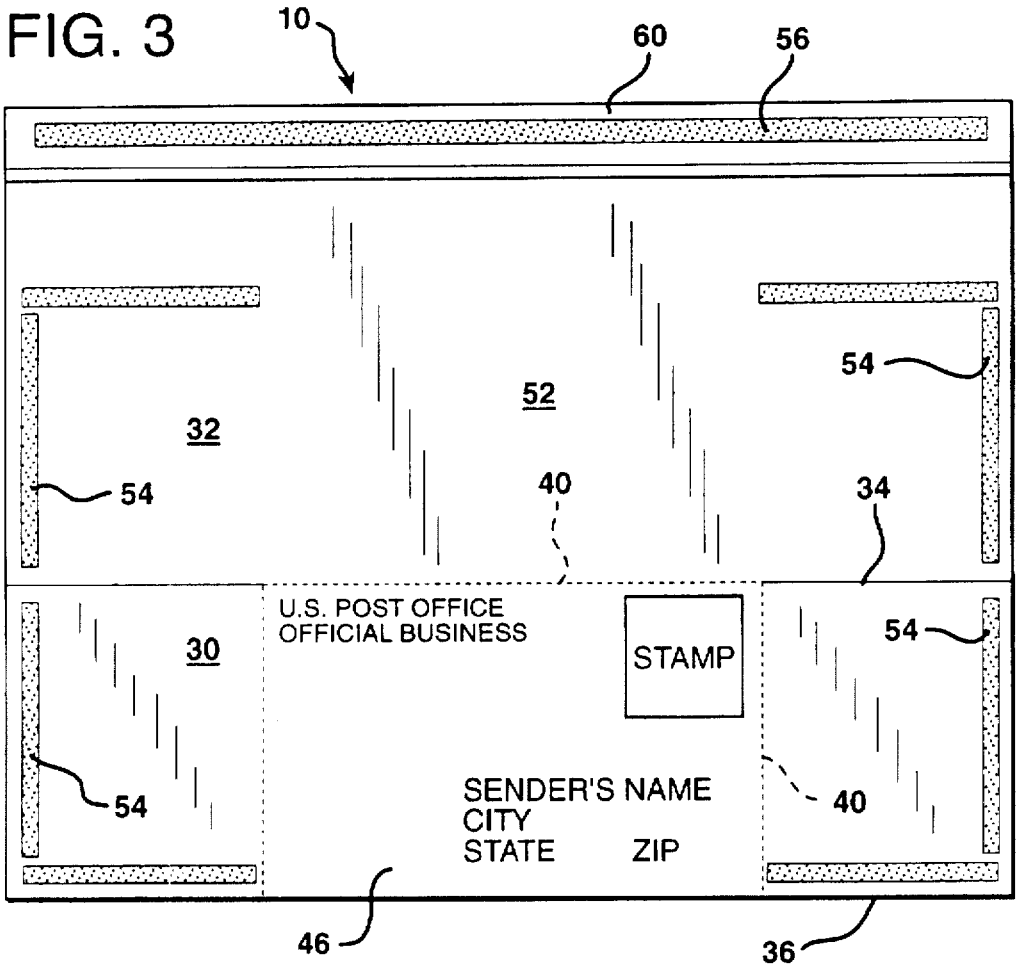
FIG. 3 is a plan view of the front (first) side of the envelope intermediate of FIGS. 1 and 2 folded about the second fold line in a single V-fold.
Figure 4:
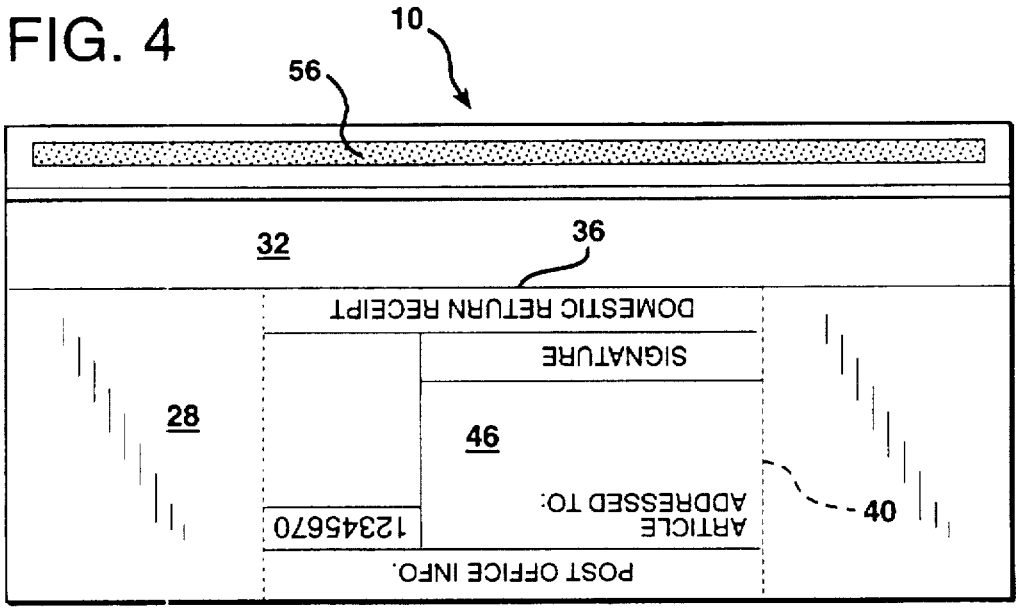
FIG. 4 is a plan view of the envelope intermediate shown in FIG. 3 folded about the first and third fold lines in double V-fold.
Figure 5:
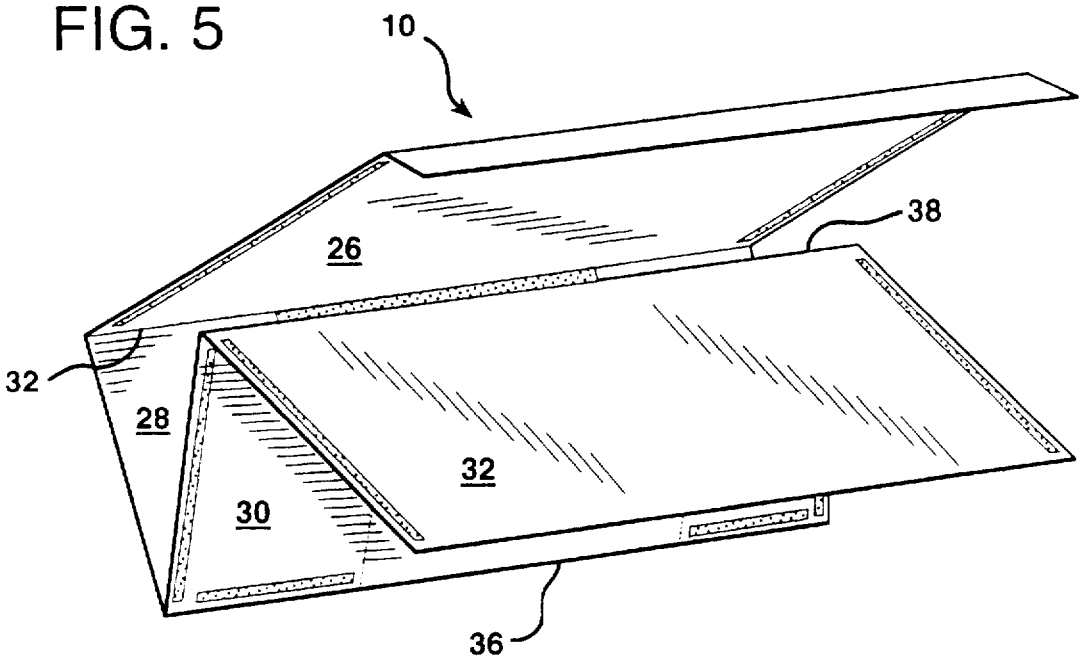
FIG. 5 is a perspective view of the envelope intermediate of FIGS. 3 and 4 folded so that the third and fourth panels lie in contact.
Figure 6:
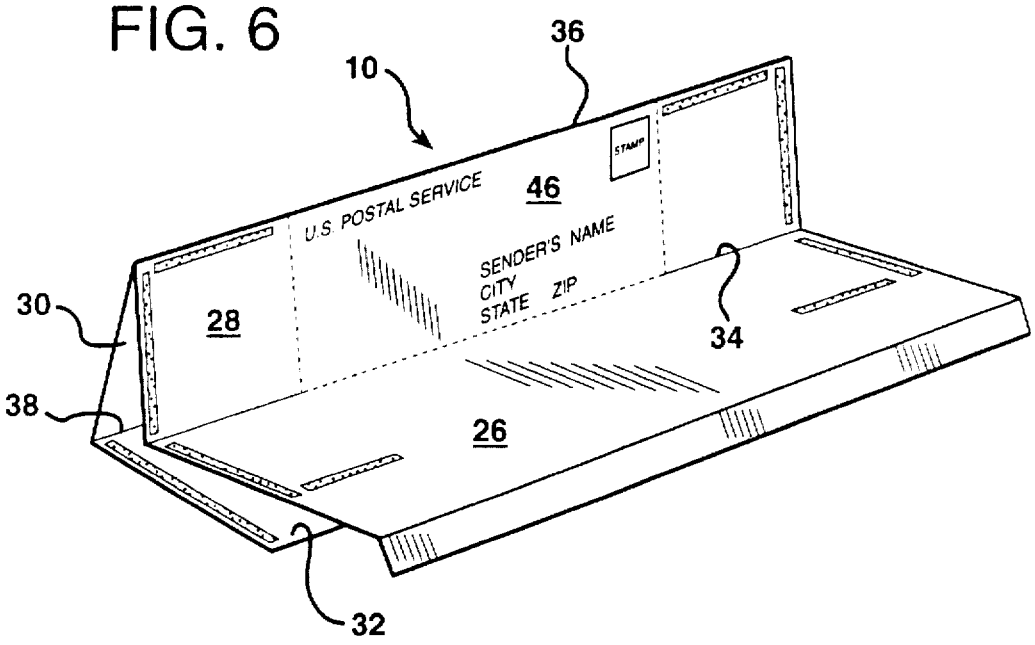
FIG. 6 is a perspective view of the envelope intermediate of FIG. 3 folded so that the second and first panels lie in contact.

That is, in order to create the intermediate 10, substrate sheet 12 is folded first about second fold line 36 so that the second surface 16 of the first panel 26 and the fourth panel 32 lie in contact and the second surface 16 of the second panel 28 and the third panel 30 also lie in contact, as shown in FIG. 3. The intermediate 10 is then subjected to a second V-fold about the first fold line 34 and the third fold line 38 which also lie in contact. The envelope 10 is folded in the second fold so that the first surface 14 of the first panel 26 lies in contact with the first surface 14 of the second panel 28, as shown in FIG. 6. Alternatively, the envelope 10 may be folded in the second fold so that the first surface 14 of the fourth panel 32 lies in contact with the first surface 14 of the third panel 30, as shown in FIGS. 4 and 5. A number of adhesive patterns, described in detail below are then used to secure intermediate 10.

Returning to FIGS. 1 and 2, a number of adhesive patterns are employed in the envelope intermediate 10 of the present invention. To permit first ply 42 to adhere to second ply 44 thereby forming integral mail-back piece 46, a first adhesive pattern 48 is provided. First adhesive pattern 48 is disposed on the second surface 16 of the first ply 42, the second ply 44, or both. Thus, when intermediate 10 is folded about the second fold line 36, as in FIG. 3, first ply 42 adheres to second ply 44 forming the integral mail-back piece 46. First adhesive pattern 48 may be a heat activated, moisture activated or pressure activated adhesive. Further, first adhesive pattern 48 may be applied to the whole, as in FIG. 2, or any portion thereof, such as the perimeter edges as in FIG. 7, of second surface 16 on first and second plies, 42 and 44.

A second adhesive pattern 50 is provided in the intermediate 10 to form an envelope 52. Second adhesive pattern 50 is disposed on the second surface 16 in the first panel 26, the fourth panel 32, or both, depending upon the adhesive employed. Second adhesive pattern 50 is disposed adjacent the first and second longitudinal edges, 18 and 20. Thus, when the intermediate 10 is folded about the second fold line 36, adhesive pattern 50 adheres the edges of the first and fourth panels, 26 and 32, forming an envelope 52, as seen in FIG. 3. Again, second adhesive pattern 50 may be heat activated by heat, moisture, or pressure.

A third adhesive pattern 54 may be provided to help secure the intermediate 10 after the second of the double V-folds. Third adhesive pattern 54 may be provided in one of two arrangements, depending upon the direction of the fold about the first and third fold lines, 34 and 38. As described above, once folded about the second fold line, as in FIG. 3, the intermediate may be folded so that either the first and second panels, 26 and 28, are in contact or the third and fourth panels, 30 and 32, are in contact.

When folded so that the first and second panels, 26 and 28, are in contact, third adhesive pattern 54 is provided on the first surface 14 of the first panel 26, the second panel 28 or both. When intermediate 10 is folded so that the third and fourth panels are in contact, third adhesive pattern 54 may be provided on the first surface of the third panel 30, the fourth panel 32, or both. Thus, when intermediate 10 is folded about the first and second fold lines, 34 and 38, the second and third panels, 28 and 30, are secured to the first and fourth panels, 26 and 32. Third adhesive 54 is preferably provided adjacent the first and second longitudinal edges, 22 and 24, although various locations may be employed. Third adhesive 54 may be activated by heat, moisture, or pressure.

Figure 7:
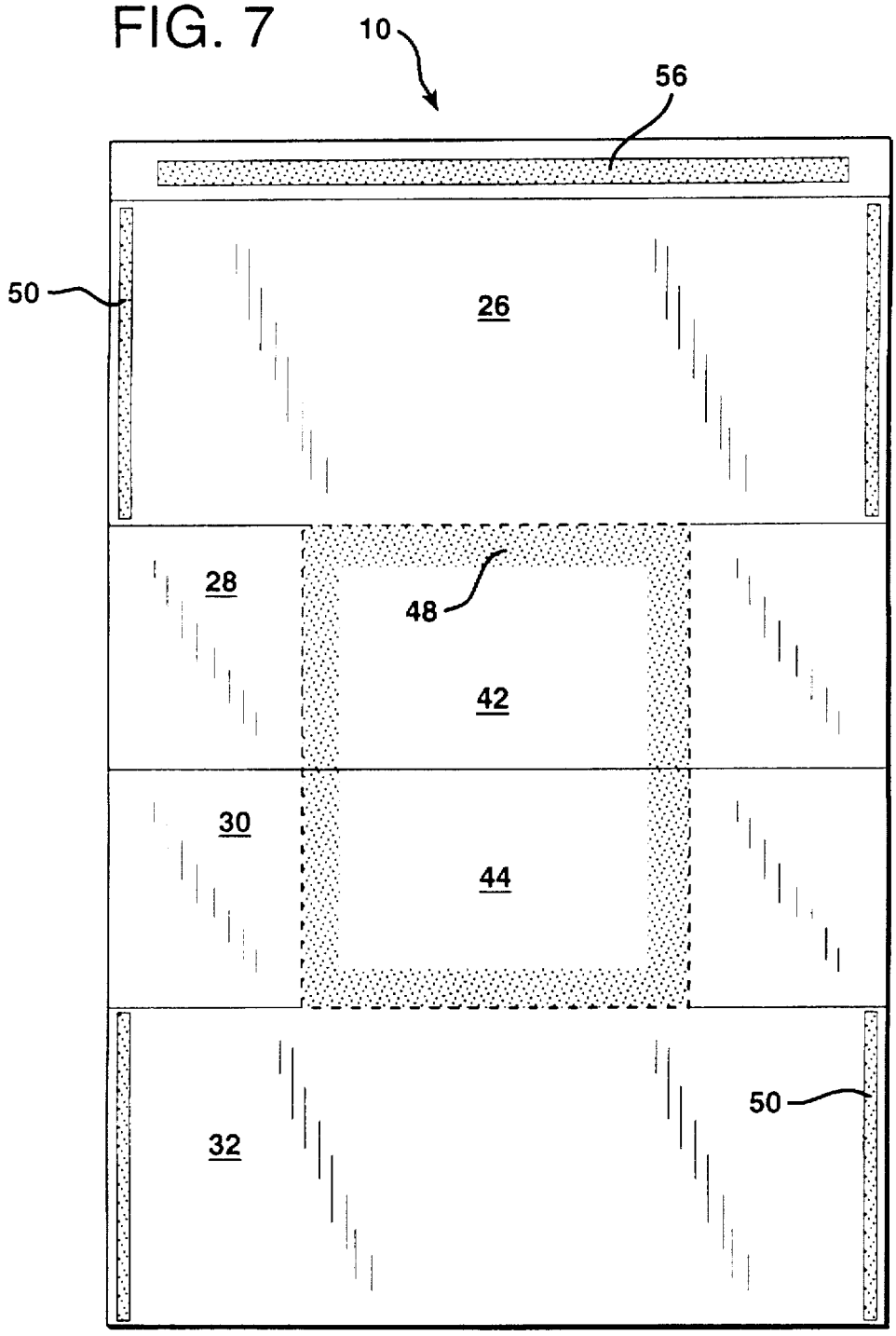
FIG. 7 is a plan view of the back (second) side of the envelope intermediate of FIG. 1 showing adhesive on the perimeter edges of the mail-back piece.

A fourth adhesive pattern 56 may be provided on the intermediate 10 to secure the envelope 52, after items to be mailed have been inserted. Fourth adhesive pattern 56 is provided adjacent either the first end 22 or the second end 24. The fourth adhesive pattern 56 secures the envelope 52. Preferably, a fourth fold line 58 is provided adjacent either the first or second end, 22 and 24. Fourth fold line 58 then defines a closure flap 60 for the envelope 52, upon which fourth adhesive pattern 56 is disposed. However, a fourth fold line 58 need not be employed to seal the envelope as shown in FIG. 7. Fourth adhesive pattern 56 may be activated by heat or pressure, but preferably is activated by moisture.

Of course, one of ordinary skill in the art will recognize that activation may be required for the various adhesives which may be employed in the present invention. For instance, hot-melt adhesive will require the application of heat to cause sealing. Remoist adhesives will require moistening for activation. Further, pressure activatable adhesives require corresponding adhesive patterns on both surfaces to be sealed to each other and the application of pressure to activate the adhesive.

Integral mail-back piece 46 is formed from first ply 42 and second ply 44. Mail-back piece 46 may be either a two-ply card, as in FIGS. 1–7, or an envelope, as in FIG. 8. Integral mail-piece 46 may occupy all or any portion of the second and third panels, 28 and 30. The only restriction as to the size of mail-back piece 46 is that it satisfy United States Postal Service specifications.

Figure 8:
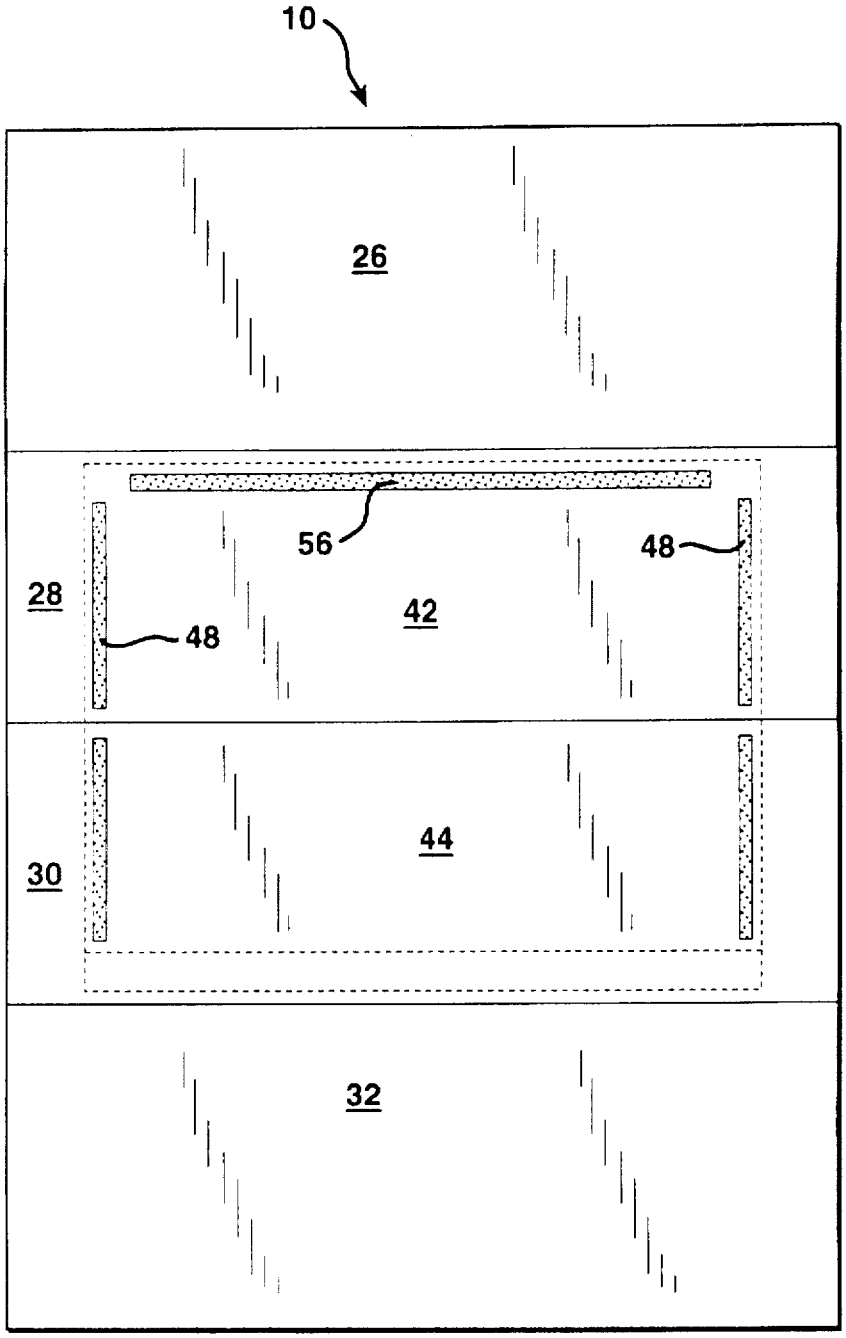
FIG. 8 is a plan view of the back (second) side of the envelope intermediate of FIG. 1 showing an envelope as the mail-back piece.

Turning to FIG. 8, first and second plies, 42 and 44, are designed to form an envelope as mail-back piece 46. To form first and second plies, 42 and 44, as an envelope, first adhesive pattern 48 is provided along three of the four perimeter edges of the first and second plies, 42 and 44. Fourth adhesive 56 may again be employed to seal the mail-back piece when designed as an envelope. A closure flap (not shown) may also be employed.

As mentioned earlier, the present invention provides a single sheet envelope intermediate. The intermediate 10 may be employed in any application in which a sender requires some form of notification of delivery, such as in certified or registered mail applications. In operation, the intermediate 10 is folded as discussed in FIG. 3–6, forming an integral mail-back piece 46 and an envelope 52. Items to be mailed may then be inserted into the envelope 52 which is then sealed with the fourth adhesive pattern 56 and posted. Upon delivery, the recipient signs the mail-back piece 46 in a provided signature area. The mail-back piece 46 is then grasped at the open edge of the mail-back piece 46 shown as the grasping point 66 in FIG. 4. The mail-back piece 46 is removed from the envelope by tearing along lines of weakness 40. The recipient may then keep the still sealed envelope 52 while the mail-back piece 46 is posted for return to the sender.

The intermediate 10 of the present invention includes space for the printing of various information, both variable and non-variable, if so desired. By variable information, it is meant information which varies from mailer to mailer such as addressee information. By nonvariable information, it is meant information which remains the same from mailer to mailer. For instance, a return address and signature block may be included on either the first or second plies, 42 and 44. Further, an outgoing address may be included on either the first or fourth panels, 26 and 32, respectively. Pre-paid postage may be included on any of the panels for both the outgoing and return addresses.

Figure 9:
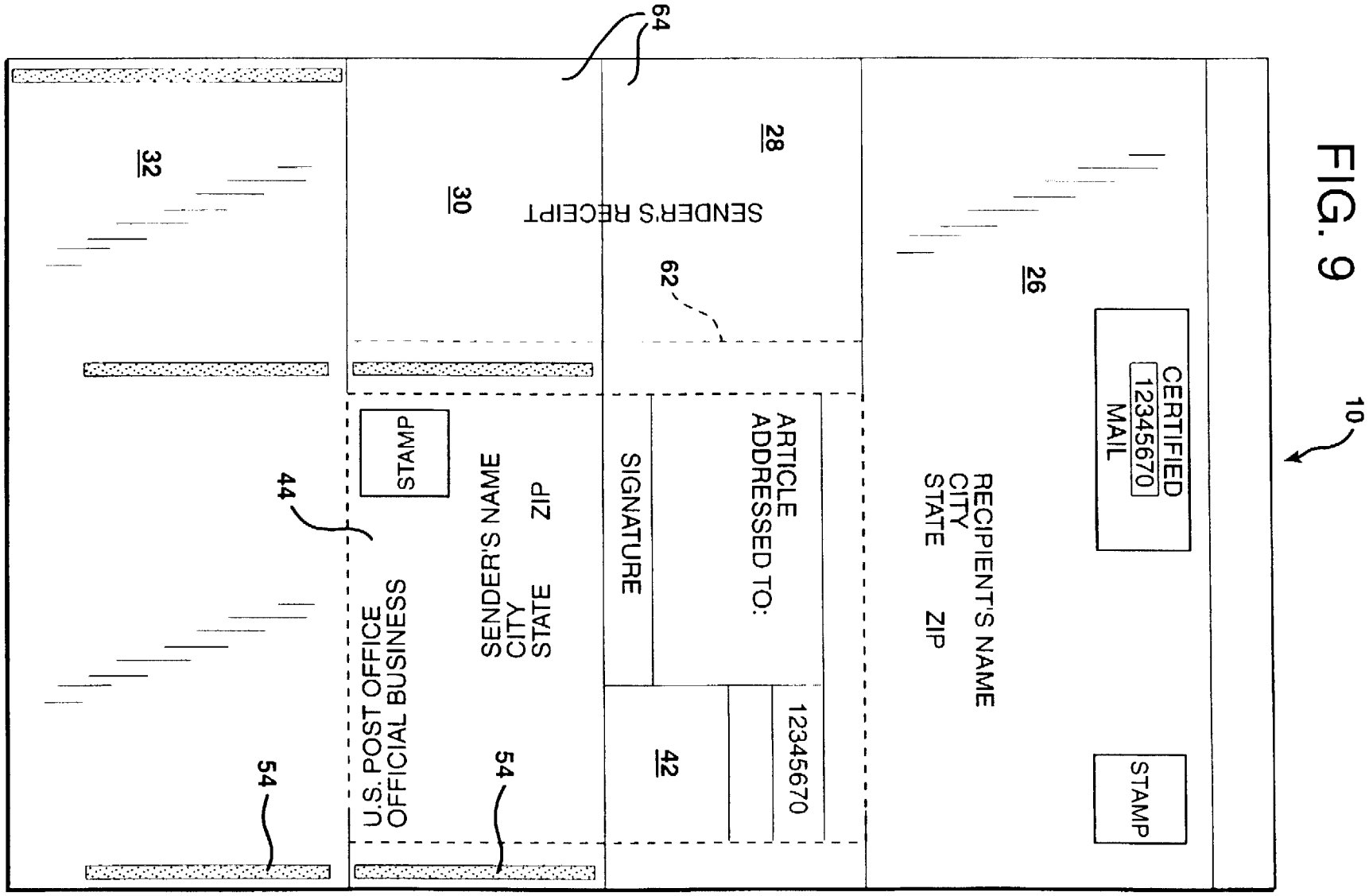
FIG. 9 is a plan view of the front (first) side of the envelope intermediate of FIG. 1 wherein a partition is included in the second and third panels.
Figure 10:
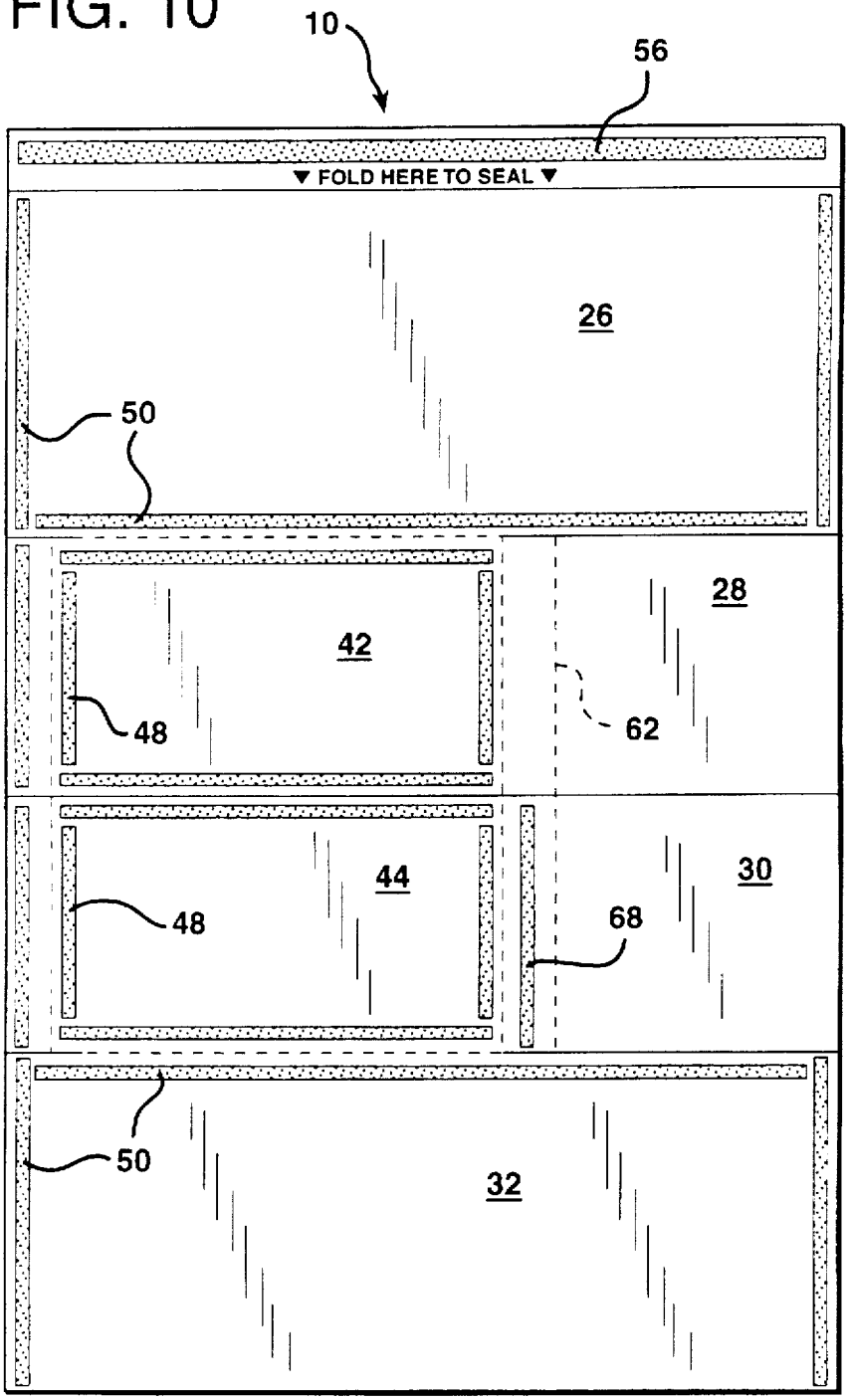
FIG. 10 is a plan view of the back (second) side of the envelope intermediate of FIG. 9.

Referring to FIGS. 9–10, there is seen an additional feature of the present invention. FIGS. 9–10 depict first and second plies, 42 and 44, being adjacent one of the longitudinal edges, 18 and 20. A line or lines of weakness 62 may then provided in the second and third panels, 28 and 30. Line of weakness 62 defines a removeable partition 64 provided in the second and third panels, 28 and 30. Once envelope intermediate 10 has been folded, partition 64 may be removed to function as a sender's receipt or other type of documentation for the sender.

To allow for additional securing of the second and third panels, 28 and 30, a fifth adhesive pattern 68 may be provided on the second surface 16 of the second panel 28, the third panel 30, or both. Preferably, fifth adhesive pattern 68 is disposed adjacent the first and second plies, 42 and 44 or adjacent the first and second longitudinal edges, 18 and 20. Fifth adhesive 68 may be a activated by heat, moisture or pressure.

Figure 11:
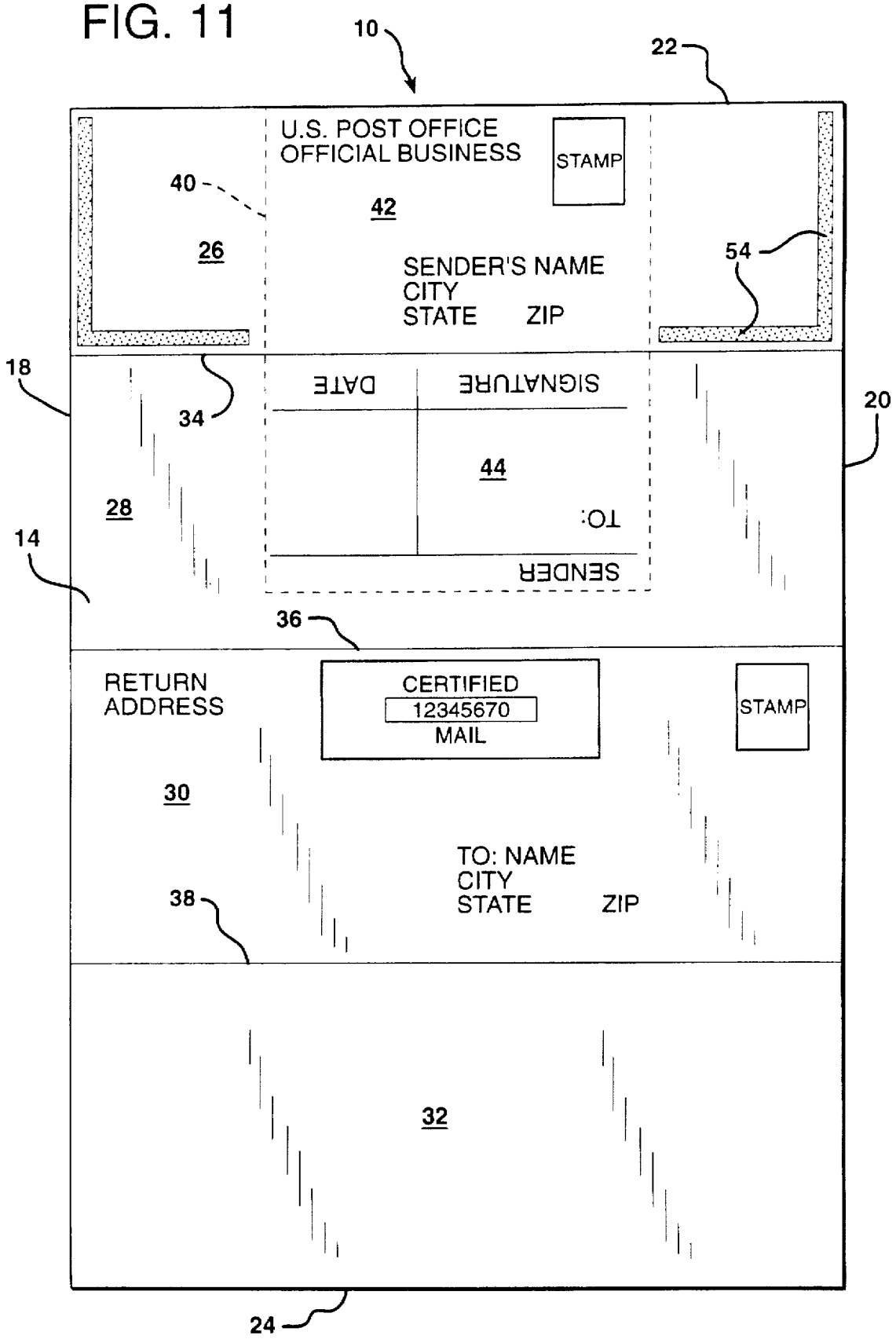
FIG. 11 is a plan view of the front (first) side of an envelope intermediate of the present invention wherein the mail-piece is located in he first and second panels.
Figure 12:
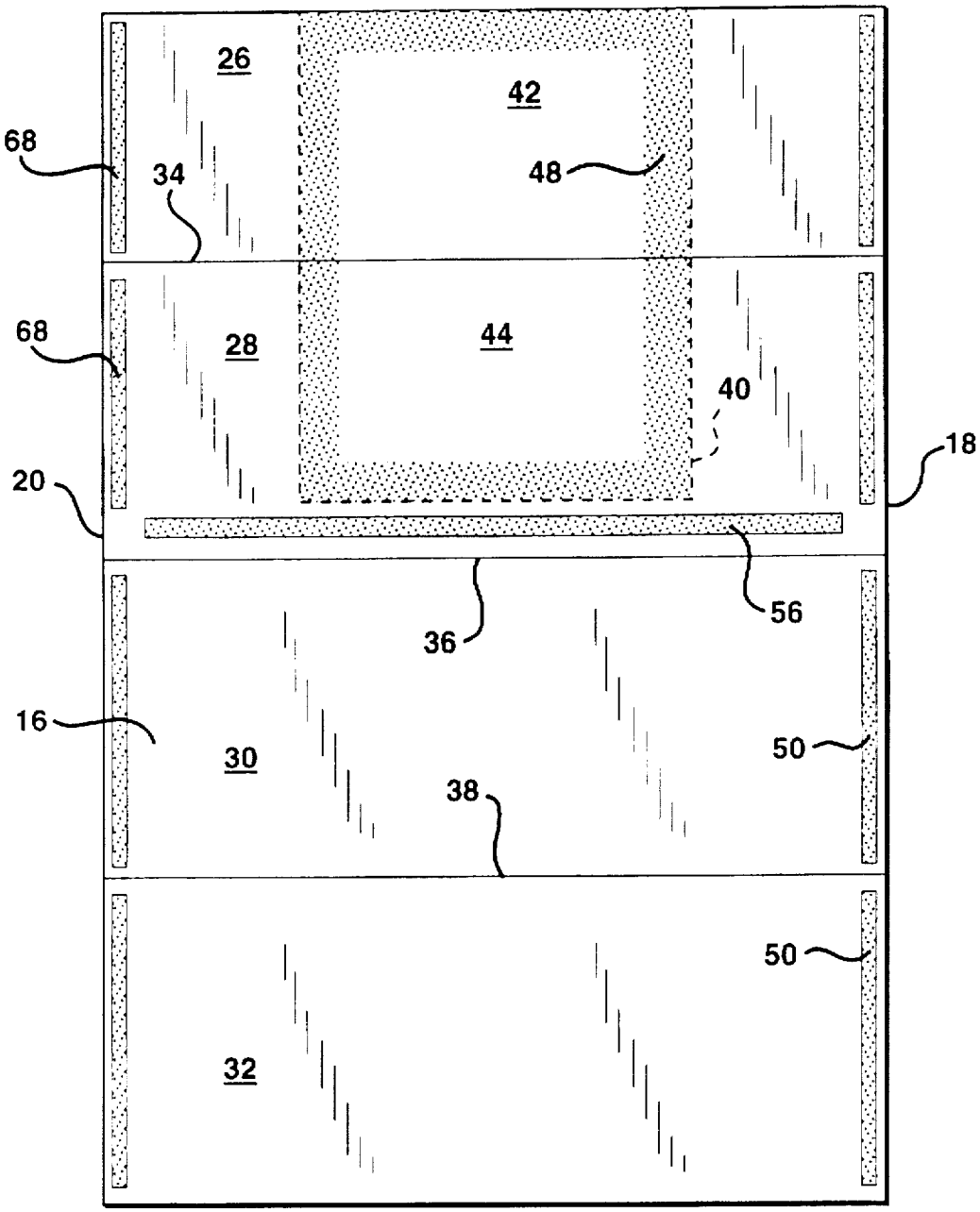
FIG. 12 is a plan view of back (second) side of the envelope intermediate of FIG. 11.

Turning now to FIGS. 11–12, there is seen an alternative embodiment to the present invention. In this embodiment, lines of weakness 40 and first and second plies, 42 and 44, are provided in the first and second panels, 26 and 28, respectively. The first adhesive pattern 48 is still provided on the second surface 16 of the first ply 42, second ply 44, or both. The second adhesive pattern 50 is provided on the second surface of the third panel 30, the fourth panel 32, or both, adjacent longitudinal edges, 18 and 20.

Figure 13:
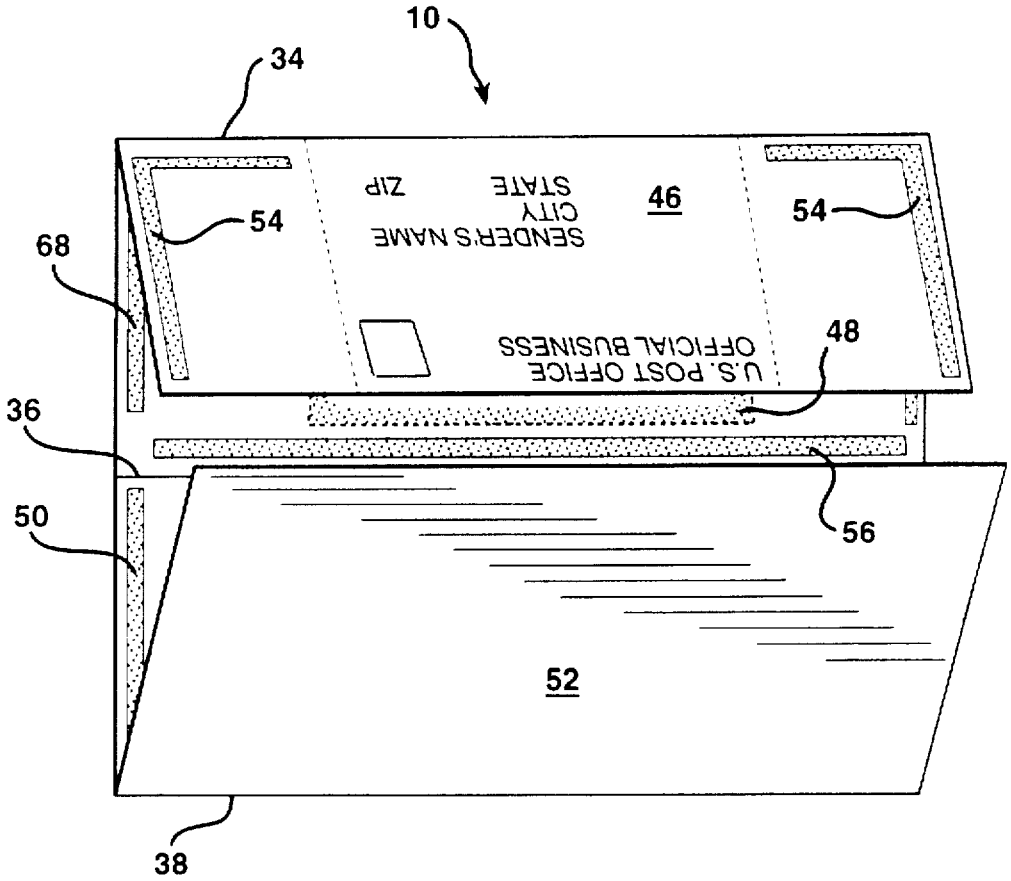
FIG. 13 is a perspective view of the envelope intermediate of FIGS. 11–12 folded about the first and third fold lines.
Figure 14:
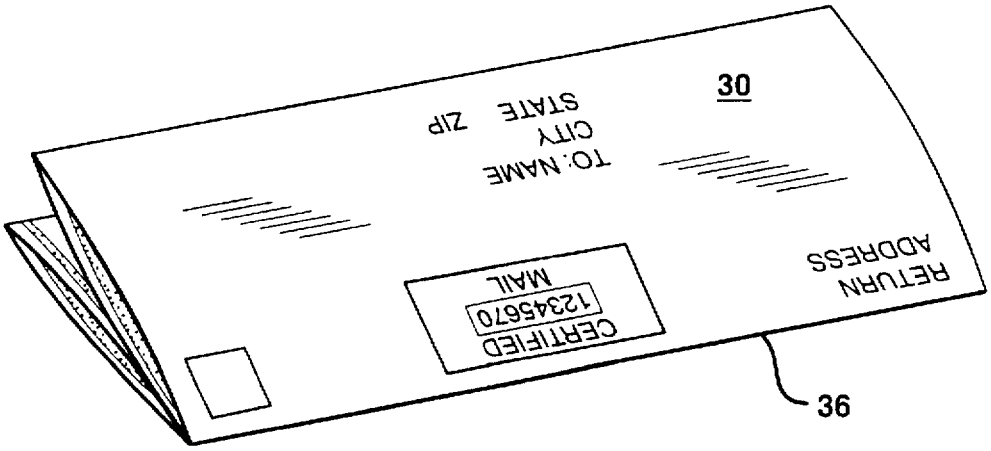
FIG. 14 is a perspective view of the envelope intermediate of FIG. 13 folded about the second fold line.

To form the envelope 52 and integral mail-back piece 46 from intermediate 10, intermediate 10 is first folded about the first and third fold lines, 34 and 38. Referring to FIGS. 13–14, there is seen the intermediate 10 of FIGS. 11–12. To form the mail-back piece 46, intermediate 10 is folded about the first fold line 34 so that the second surface 16 of first ply 42 and the second surface 16 of second ply 44 are in contact with each other. First adhesive 48 then acts to adhere the two plies, and form integral mail-back piece 46.

To form the envelope 52 of the present embodiment, intermediate 10 is folded about third fold line 38 so that the second surfaces 16 of the third panel 30 and the second surface 16 of the fourth panel 32 lie in contact. Second adhesive 50 then acts to form envelope 52. The intermediate 10 may then be folded about the second fold line 36 to secure the mail-back piece 46 to the envelope 52, as shown in FIG. 14. When folded about second fold line 36, third adhesive pattern 54 is disposed on the first surface 14 of the first panel 26. Fifth adhesive pattern 68 may be disposed in the first and/or second panels, 26 and 28 respectively, adjacent either first and second plies, 42 and 44 or first and second longitudinal edges, 18 and 20. Again, first, second, third and fifth adhesive patterns, 48, 50, 54 and 68, respectively are activated by heat, moisture, or pressure.

As before, mail-back piece 46 may be a two-ply card or envelope. Lines of weakness (not shown) defining a partition (not shown) as before may also be included in the first and second panels, 26 and 28. To close the envelope 52 when items for mailing are enclosed, fourth adhesive pattern 56 may be provided adjacent the second fold line 36 in either the second panel 28 or third panel 30. Lines of weakness (not shown) forming a closure flap (not shown) for fourth adhesive 56 may also be included as before.

Having described the invention in detail and by reference to the preferred embodiment thereof, it will be apparent that modifications and variations are possible without departing from the scope of the invention which is defined in the appended claims.

What is claimed is:

1. A folded envelope including an integral two-ply mail-back piece which is detachable from said envelope without opening said envelope, said envelope comprising:

a substrate sheet having first and second surfaces, first and second opposite parallel longitudinal edges, and first and second opposite end edges;

first, second and third transverse fold lines formed in said substrate perpendicular to said parallel longitudinal edges, dividing said substrate into first, second, third and fourth panels, said first fold line separating said first and second panels, said second fold line separating said second and third panels, said third fold line separating said third and fourth panels;

a first adhesive pattern provided on said second surface of at least one of said second and third panels, and lines of weakness disposed in said second and third panels;

a second adhesive pattern provided on said second surface of at least one of said first and fourth panels adjacent said first and second longitudinal edges of said substrate sheet; and said substrate sheet being folded such that: (a) said second surfaces of said second and third panels lie in contact and are adhered together by said first adhesive pattern to form said integral two-ply mail-back piece, said lines of weakness permitting detachment of said mail-back piece without opening said envelope, and (b) said second surfaces of said first and fourth panels lie in contact and are adhered together by said second adhesive pattern to form said envelope; said envelope further including a third adhesive pattern provided on said first surface on at least one of said first and second or third and fourth panels so that when said substrate is folded about said first and third fold lines said first surfaces of either said first and second or said third and fourth panels lie in contact and are adhered together by said third adhesive pattern.

2. The folded envelope as claimed in claim 1 wherein said mail-back piece is a two-ply card.

3. The folded envelope as claimed in claim 1 wherein said mail-back piece is an envelope.

4. The folded envelope as claimed in claim 1 further including at least one line of weakness provided in at least one of said second and third panels thereby defining a partition.

5. The folded envelope as claimed in claim 1 wherein said first and second adhesive patterns are pressure activatable adhesives.

6. The folded envelope intermediate as claimed in claim 1 wherein said third adhesive pattern is a pressure activatable adhesive.

7. The folded envelope as claimed in claim 1 wherein a fourth fold line is provided adjacent one of said first and second opposing end edges thereby defining a closure flap upon which a fourth adhesive pattern is disposed, and wherein said closure flap has been folded such that said fourth adhesive seals said envelope.

8. The folded envelope as claimed in claim 7 wherein said fourth adhesive pattern is a moisture activatable adhesive.

* * * * *